US006099347A

United States Patent [19]

Hoyt et al.

[11] Patent Number: 6,099,347

[45] Date of Patent: Aug. 8, 2000

[54] LOW PROFILE SHUNT CONNECTOR

[75] Inventors: Tim Keith Hoyt, Mentor; Steven Feldman, Madison, both of Minn.; Kok Hong Ng, Singapore, China

[73] Assignee: 3M Innovative Properties Company, Saint Paul, Minn.

[21] Appl. No.: 09/379,882

[22] Filed: Aug. 24, 1999

Related U.S. Application Data

[63] Continuation of application No. 08/806,307, Feb. 26, 1997, Pat. No. 6,036,534.

[51] Int. Cl.[7] ..... H01R 31/08

[52] U.S. Cl. ..... 439/510; 439/483; 439/590

[58] Field of Search ..... 439/510, 513, 439/476.1, 483, 481, 160, 152, 590

[56] References Cited

U.S. PATENT DOCUMENTS

| | | | |
|---|---|---|---|
| 3,488,620 | 1/1970 | Sullivan et al. | 339/19 |
| 3,932,013 | 1/1976 | Yeager et al. | 339/19 |
| 4,029,377 | 6/1977 | Guglielmi | 339/19 |
| 4,067,637 | 1/1978 | Narozny | 339/176 |
| 4,070,557 | 1/1978 | Ostapovitch | 200/51.1 |
| 4,383,724 | 5/1983 | Verhoeven | 339/19 |
| 4,392,702 | 7/1983 | Walkup | 339/19 |
| 4,449,771 | 5/1984 | Carr | 339/198 |
| 4,470,652 | 9/1984 | Schwab | 339/19 |
| 4,501,459 | 2/1985 | Chandler et al. | 339/48 |
| 4,516,817 | 5/1985 | Deters | 339/19 |
| 4,552,423 | 11/1985 | Swengel, Jr. | 339/19 |
| 4,589,718 | 5/1986 | Szczesny | 339/95 |
| 4,602,833 | 7/1986 | Grabbe et al. | 339/19 |
| 4,602,834 | 7/1986 | Hahn et al. | 339/19 |
| 4,607,899 | 8/1986 | Romine et al. | 339/19 |
| 4,680,568 | 7/1987 | Corrao et al. | 337/186 |
| 4,693,531 | 9/1987 | Raphal et al. | 439/512 |
| 4,717,058 | 1/1988 | Gobert | 225/93 |
| 4,744,769 | 5/1988 | Grabbe et al. | 439/284 |
| 4,769,896 | 9/1988 | Denlinger et al. | 29/509 |
| 4,786,258 | 11/1988 | Shaffer et al. | 439/188 |
| 4,820,194 | 4/1989 | Stine | 439/510 |
| 4,820,195 | 4/1989 | Siemon | 439/510 |
| 4,832,614 | 5/1989 | Jenkins | 439/188 |
| 4,846,733 | 7/1989 | Baisz et al. | 439/622 |
| 4,850,888 | 7/1989 | Denlinger et al. | 439/188 |
| 4,883,430 | 11/1989 | Siemon et al. | 439/510 |
| 4,941,832 | 7/1990 | Korsunsky et al. | 439/71 |
| 4,952,170 | 8/1990 | Pritulsky | 439/509 |
| 5,030,121 | 7/1991 | Noorily | 439/188 |
| 5,037,320 | 8/1991 | Stolte | 439/188 |
| 5,071,362 | 12/1991 | Martens et al. | 439/188 |
| 5,085,601 | 2/1992 | Buchter et al. | 439/660 |
| 5,104,329 | 4/1992 | Brown et al. | 439/108 |
| 5,169,337 | 12/1992 | Ortega et al. | 439/510 |
| 5,277,608 | 1/1994 | Oda | 439/188 |
| 5,312,261 | 5/1994 | Burke et al. | 439/52 |
| 5,312,273 | 5/1994 | Andre et al. | 439/607 |
| 5,374,200 | 12/1994 | Giroux | 439/188 |
| 5,405,268 | 4/1995 | Gazzara et al. | 439/188 |
| 5,427,546 | 6/1995 | Garritano et al. | 439/502 |
| 5,449,301 | 9/1995 | Hanna et al. | 439/510 |
| 5,487,684 | 1/1996 | Schalk et al. | 439/715 |
| 5,494,450 | 2/1996 | Kirsch et al. | 439/188 |
| 5,542,853 | 8/1996 | Bouchan | 439/188 |
| 5,553,907 | 9/1996 | Kozel et al. | 439/188 |
| 5,558,529 | 9/1996 | Romatzick, Jr. | 439/188 |
| 5,584,724 | 12/1996 | Shibata et al. | 439/507 |

FOREIGN PATENT DOCUMENTS

WO 95/14318 5/1995 WIPO .

*Primary Examiner*—Gary F. Paumen
*Attorney, Agent, or Firm*—Matthew B. McNutt

[57] ABSTRACT

An electrical shunt for shorting adjacent electrically conductive pins in an array of electrically conductive pins includes an insulative housing containing an electrically conductive contact. The conductive contact preferably includes two longitudinal wipers for making electrical contact with each pin. The longitudinal wipers are connected by a transverse spring portion which provides a normal force between the contact and inserted pins. The shunt has a pin insertion axis which is transverse to the contact insertion axis to prevent the contact from inadvertently being dislodged from the housing during installation or removal of the shunt. When conductive pins are inserted into the housing, the pins are electrically connected between the first and second wipers of the conductive contact. The shunt preferably includes a frangibly attached application tool and extraction tool.

15 Claims, 8 Drawing Sheets

LOW PROFILE SHUNT CONNECTOR

This is a continuation of application No. 08/806,307 filed Feb. 26, 1997, now U.S. Pat. No. 6,036,534 issued Mar. 14, 2000.

FIELD OF THE INVENTION

The present invention relates generally to electrical connectors. More particularly, this invention relates to shunt connectors (also known as jumpers) for providing an electrical connection between adjacent terminal pins inserted into the shunt.

BACKGROUND OF THE INVENTION

Shunt connectors are well known in the art. Shunt connectors provide an electrical connection between two adjacent electrically conductive terminal pins when the pins are inserted into the shunt. When the terminal pins are inserted into the shunt, the pins contact a conductive member within the shunt to establish electrically continuity between the pins in a known manner. Depending upon the user's requirements, the shunt may be used to provide either a permanent or a temporary electrical connection to pins on a printed circuit board or the like.

Although the use of shunts to connect multiple pins in an array of electrically conductive pins, and in particular, to connect two adjacent pins in such an array is well known, the shunts of the prior art are usually deficient in several aspects. The prior art shunts are relatively bulky. The shunts typically have a profile which is too large to be easily used in electronic equipment which is becoming smaller and smaller.

The prior art shunts are often difficult to install, and even more difficult to remove or relocate. The shunts are often applied with inappropriate tools such as tweezers or fingers and removed in a similar manner. Because of the size and fragile nature of the components, damage to the shunt or the pins often results. If a metal application or removal tool is used, inadvertent shorting of the pins may occur. This problem only worsens as the size of the components decreases.

It is also common for the conductive member of prior art shunts to come out of the insulative housing as the shunt is being removed or applied. If the contact comes out of the housing when the shunt is being removed the conductive member is left on the pins without an insulative housing. It may then be impossible to remove the unprotected conductive member, or damage to the pin field may result from the attempt to remove the conductive member. Similarly, the contact may come out of the housing as the shunt is being installed, leaving the housing around the pins, but missing the conductive member.

Finally, although it is common to attach a large number of shunts to a single pin field, often in series, the prior art shunts are typically applied individually, making application of a large number of shunts very labor intensive and time consuming.

There thus exists a need for a shunt having a low profile which is suitable for use in applications with decreasing size requirements, which is easily installed and removed without damage to itself or the pin field, and which can be applied in large numbers with relative ease.

SUMMARY OF THE INVENTION

The present invention is a low profile shunt having an insulative housing containing an electrically conductive contact. The contact provides at least one wiping surface which makes electrical contact with each pin. The longitudinal axis of the wiping surface is transverse to the pin insertion axis, and the contact provides high compliance and high normal force against the pins to ensure a reliable electrical connection. The conductive contact is inserted into the housing in a direction transverse to the pin insertion axis, such that it is impossible for the conductive contact to come out of the housing as the shunt is being inserted or removed from the pin field. The housing has an integrally molded application handle which is frangibly connected to the housing, such that the handle can be removed before or after installation of the shunt. In a preferred embodiment, a series of shunts are attached to each other with a pitch that matches the pitch of the pin field, or a multiple thereof, such that a plurality of shunts can be installed simultaneously. The series of shunts are preferable frangibly connected, such that an individual shunt and application handle can be removed if only a single shunt is required. An extraction tool is also integrally molded and frangibly attached to the series of shunts.

DETAILED DESCRIPTION OF THE INVENTION

Figure 1:
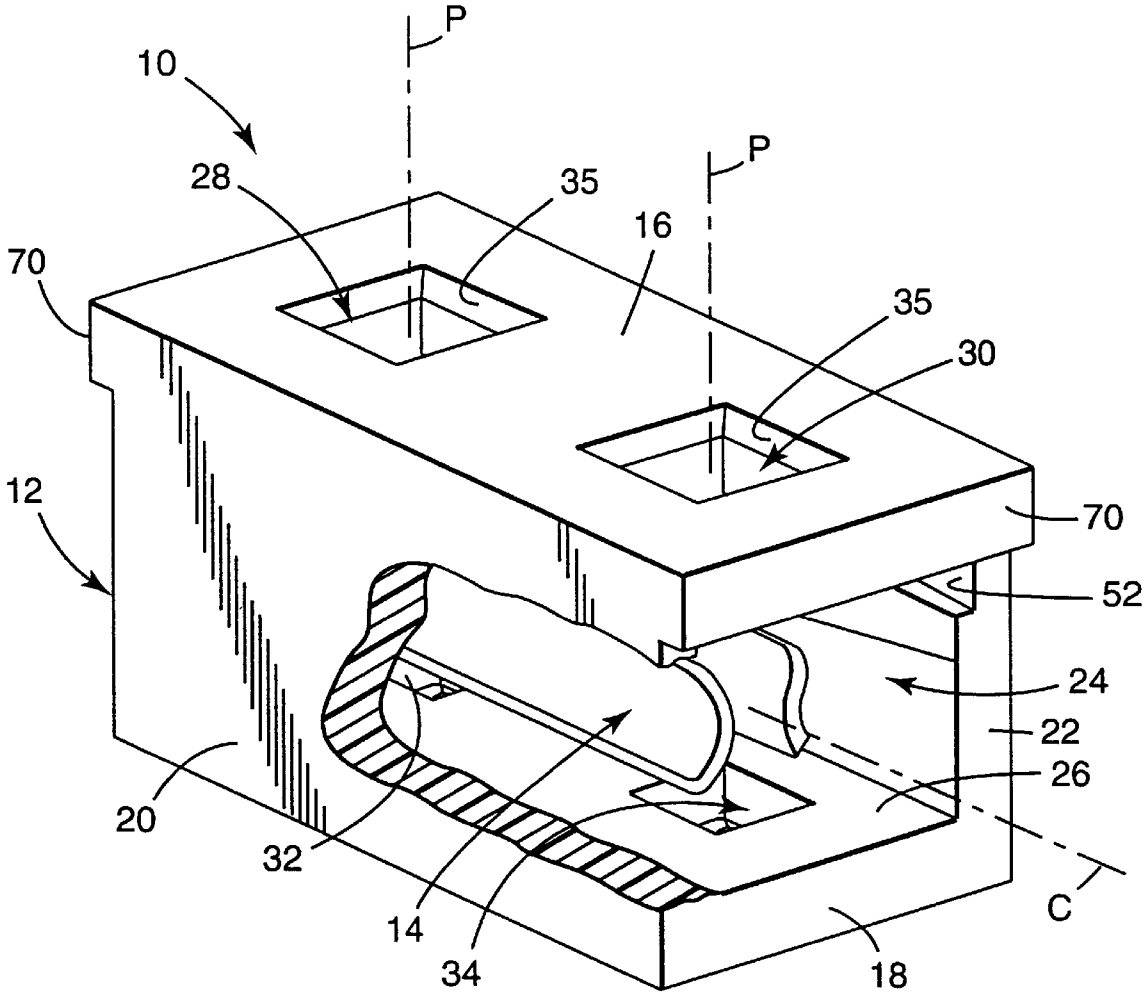
FIG. 1 is a perspective view of the inventive shunt.

FIG. 1 depicts a shunt 10 in accordance with the preferred embodiment of the present invention. Shunt 10 includes a housing 12 and an electrically conductive contact 14 within housing 12. Housing 12 is formed by a top wall 16, a bottom wall 18, a first side wall 20 and a second side wall 22. Top wall 16, bottom wall 18, and side walls 20, 22 define a cavity 24 within housing 12. Cavity 24 is adapted to receive contact 14, and has at least one open end 26 for inserting contact 14 into cavity 24. Contact 14 is inserted into cavity 24 along contact insertion axis C.

Top wall 16 has first opening 28 and second opening 30 which extend through top wall 16 and into cavity 24. Similarly, bottom wall 18 has first opening 32 and second opening 34 which extend through bottom wall 18 and into cavity 24. Openings 28, 30, 32, 34 are adapted to receive conductive pins (not shown) and define a pin insertion axis P. Openings 28, 30 in top wall 16 are aligned with openings 32, 34, respectively in bottom wall 18. Preferably openings 28, 30, 32, and 34 have tapered edges 35 to guide the pins into the openings 28, 30, 32, 34. In an alternate embodiment of the inventive shunt, only one set of pin insertion openings 32, 34 could be provided, if versatility in inserting pins from either the top or bottom of the shunt 10 is not required.

It is important to note that pin insertion axis P is transverse to contact insertion axis C, as best seen in FIG. 1. Because pin insertion axis P is transverse to contact insertion axis C, contact 14 cannot be inadvertently pulled out of housing 12 when shunt 10 is applied or removed. This is a significant advantage over prior art shunts which insert the contact and pins along the same axis.

Figure 2:
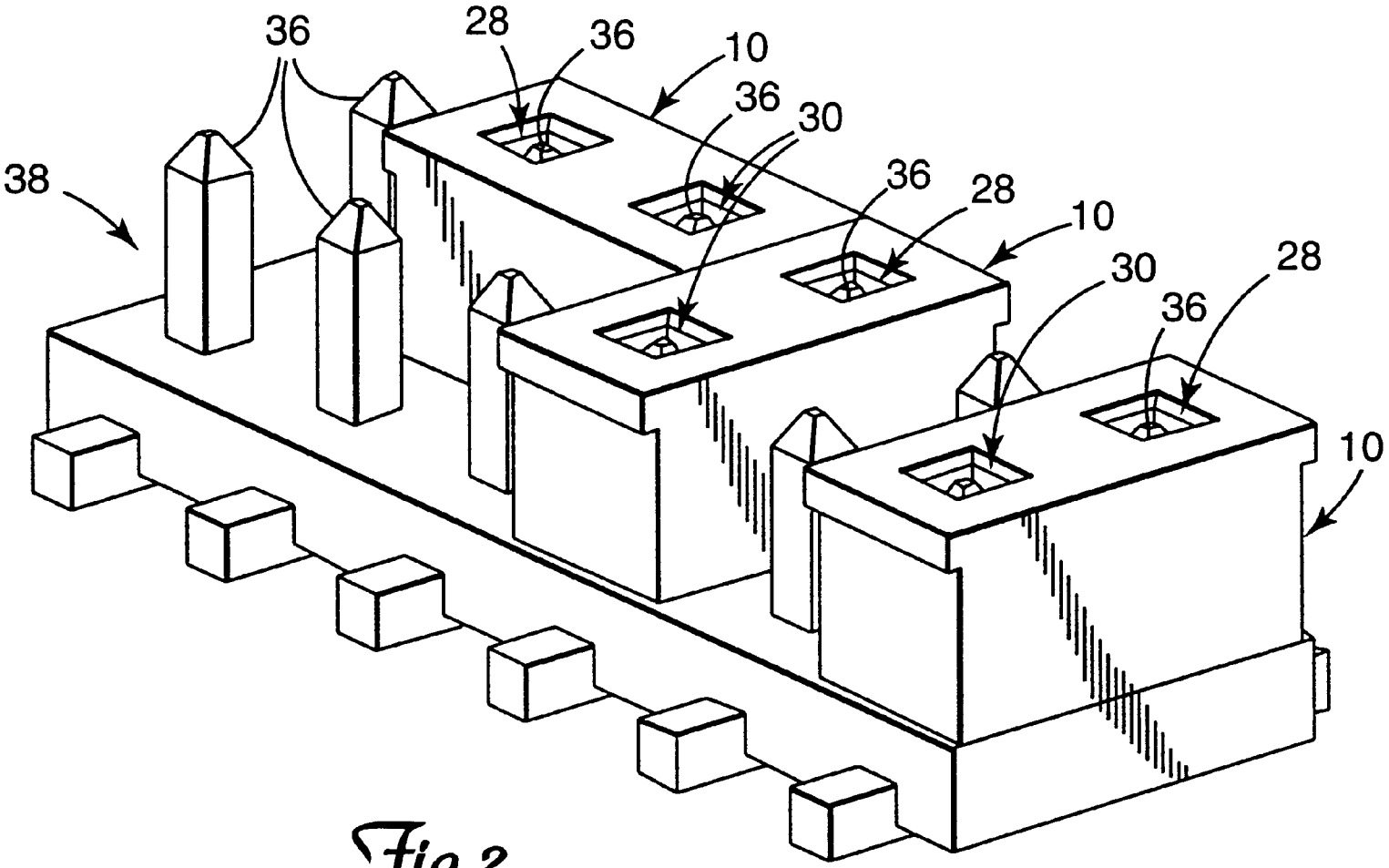
FIG. 2 is a perspective view of the shunt of FIG. 1 installed on a pin field.

As best seen in FIG. 2, first openings 28 are spaced from second openings 30, respectively, by a distance equal to the spacing between adjacent pins 36 in pin field 38 on which shunt 10 is to be installed, such that a pair of adjacent pins 36 may be inserted into shunt 10. Pins 36 may thus be inserted either through holes 28, 30 in top wall 16 or through holes 32, 34 in bottom wall 18.

Figure 3A:
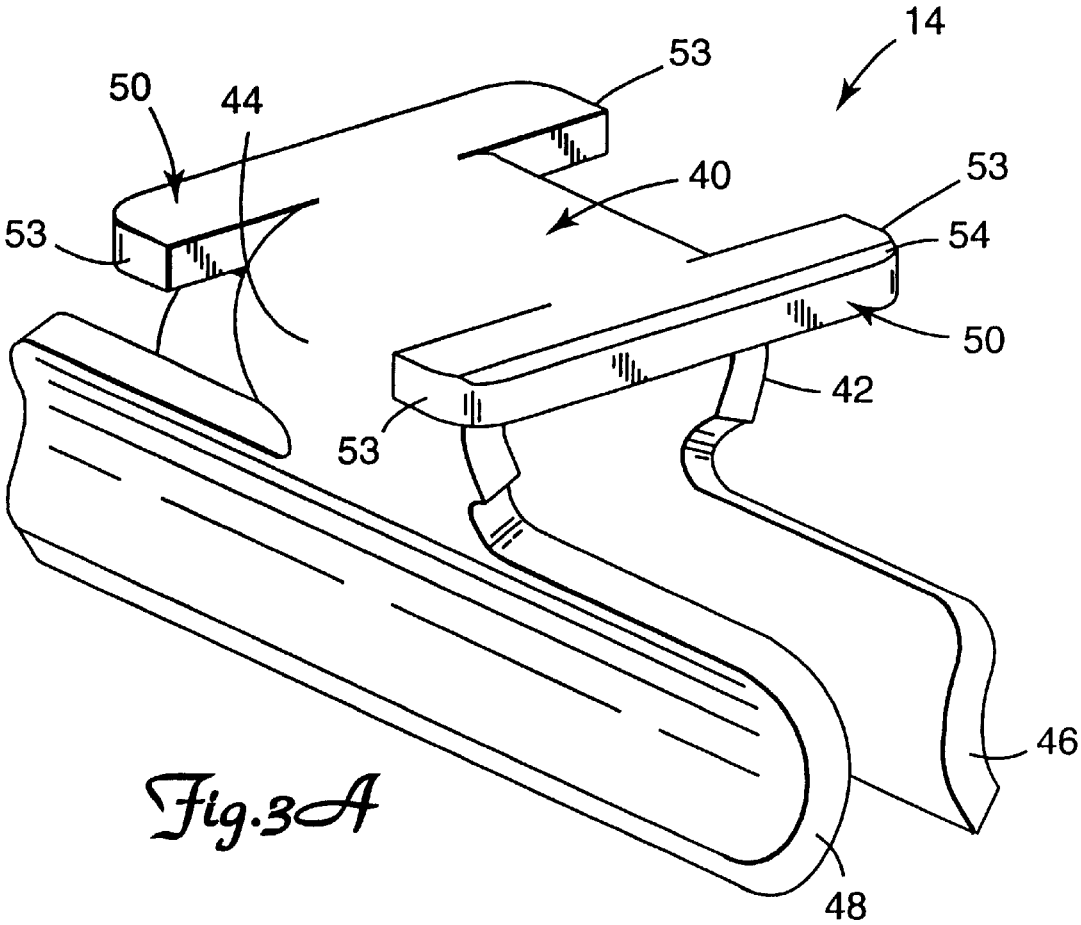
FIG. 3A is a perspective view of the conductive contact of the shunt of FIG. 1.

As noted above, contact 14 in positioned within cavity 24. As best seen in FIG. 3A, contact 14 is preferably a spring clip design formed from a single piece of resilient, electrically conductive material. A preferred material is copper alloy, although other equally suitable materials will be known to those skilled in the art. Contact 14 includes a compliant spring portion 40 which extends into first leg 42 and second leg 44. A first longitudinal wiper 46 and a second longitudinal wiper 48 extend transversely from first leg 42 and second leg 44, respectively, such that wipers 46, 48 are generally parallel to each other. When pins 36 are inserted into shunt 10, pins 36 are pressed between wipers 46, 48 and electrical contact is made between the pins 36 and contact 14. Wipers 46, 48 preferably have a flared or curved profile, as seen in FIG. 3A. A flared profile functions to stiffen wipers 46, 48, and allows a longer contact beam to be used. The flared profile also provides a beveled guide for pins 36 as they are inserted between wipers 46, 48, thereby easing pin insertion.

Contact 14 further includes contact guides 50 which aid in inserting and retaining contact 14 in housing 12. Contact guides 50 are received by guide channels 52 in cavity 24, such that guide channels 52 accurately position contact 14 within housing 12. As contact 14 is positioned within housing 12, side edges 53 of contact guides 50 are press fit into guide channels 52 such that contact 14 is held firmly in position within housing 12. It has been found desirable to make contact guides 50 asymmetrical, such that one contact guide is slightly wider than the other contact guide. By making contact guides 50 asymmetrical, insertion of contact 14 is made easier, the wider contact guide 50 retains contact 14 within the housing, and the second contact guide provides stability and improved location control for contact 14. Finally, it is preferred that the leading edge 54 of contact guides 50 be provided with a chamfered edge, so as to prevent any skiving of housing 12 as contact 14 is inserted. If leading edge 54 is not chamfered, it is possible that small amounts of housing 12 could be shaved off as contact 14 is inserted, and such small shavings could interfere with the performance of the shunt.

It should be noted that the above described method of securing contact 14 within housing 12 isolates wipers 46, 48 from housing 12. This is best seen in FIG. 1. By preventing the compliant portions of contact 14 from contacting housing 12, the compliancy of contact 14 is improved, and inadvertent damage which may result from rubbing between contact 14 and housing 12 is avoided. Further, the forces exerted by contact 14 are isolated from housing 12, thereby eliminating contact reaction forces from stressing housing 12.

Figure 4:
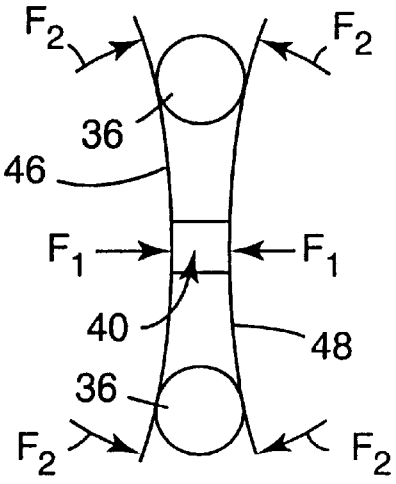
FIG. 4 is a schematic diagram of the forces exerted by the conductive contact of FIG. 3A.

Contact 14 improves the reliability of the electrical connection with pins 36 over prior art contacts by providing high compliancy and a high normal force. The compliancy of contact 14 allows contact 14 to provide a high normal force to pins 36 over a range of deflection, such that contact 14 will provide good electrical contact with more than one size of pin 36. FIG. 4 schematically illustrates the forces exerted by contact 14. The spring action between legs 42, 44 urges wipers 46, 48 toward each other and creates a first force $F_1$. As pins 36 are inserted between wipers 46, 48, the wipers are bowed and exert a second force $F_2$. This dual cantilever spring design results in a greater normal force exerted by wipers 46, 48 against pins 36, while at the same time permitting the shunt to maintain a low profile. In addition, because each side of the contact is independently compliant, the design tends to balance the forces at all four contact points, such that no bending or twisting moments are exerted on either the pins or the shunt itself.

Figure 3B:
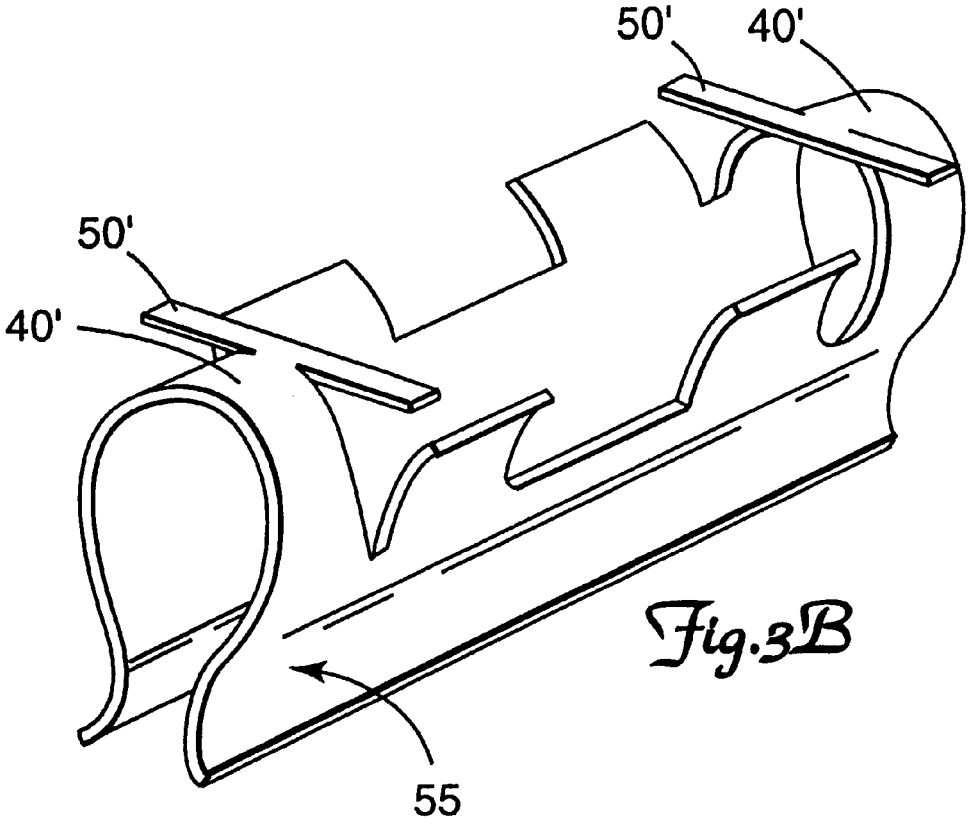
FIG. 3B is an alternate conductive contact design.
Figure 3C:
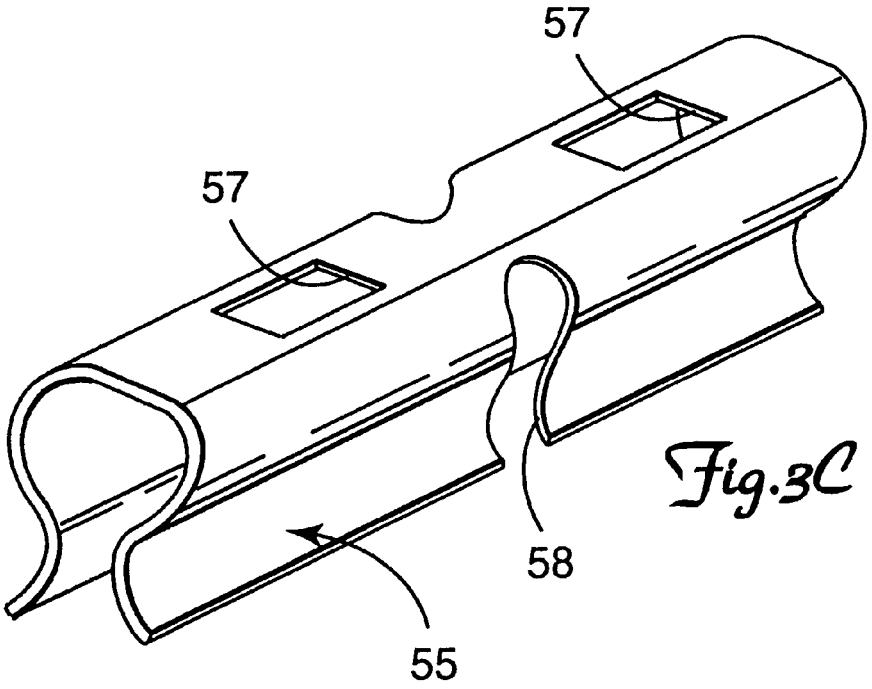
FIG. 3C is an alternate conductive contact design.

The contact 14 described above is the preferred embodiment for the present invention. However, alternate contact designs are contemplated. For example, FIGS. 3B and 3C show alternate contact designs that would provide suitable performance in the inventive shunt. FIG. 3B illustrates a contact having two spring sections 40', flared waist 55, and contact guides 50'. FIG. 3C provides a continuous spring clip shape with pin apertures 57 and an optional cutout center section 58 which increases the independence of forces on each pin. Flared waste 55 provides a pin lead-in to ease pin entry into the contact. The above alternate contact designs are intended to be illustrative and not exhaustive, as it is contemplated that additional contact designs could be readily conceived by those skilled in the art.

Figure 5:
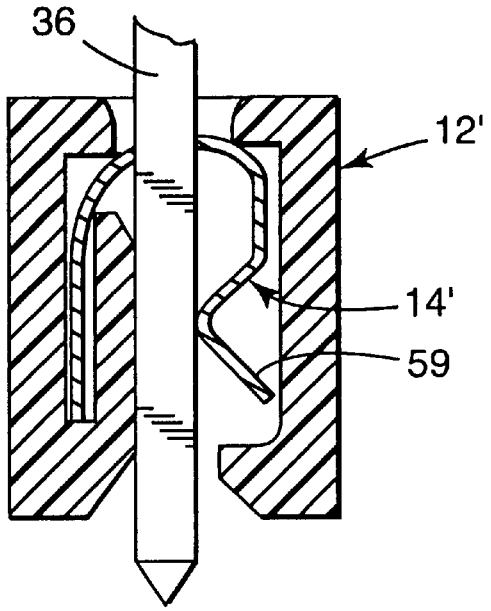
FIG. 5 is an alternate embodiment of the inventive shunt.

It is further contemplated that the inventive shunt could utilize a contact having only a single contact point per pin. As illustrated in FIG. 5, housing 12' could be formed to receive a contact 14' having a spring clip shape in which only a single arm 59 of the contact 14' makes electrical connection with the inserted pin 36. Such an alternate embodiment would provide the benefit of a pin insertion axis which is transverse to the contact insertion axis, as well as the further benefits described below.

Figure 6:
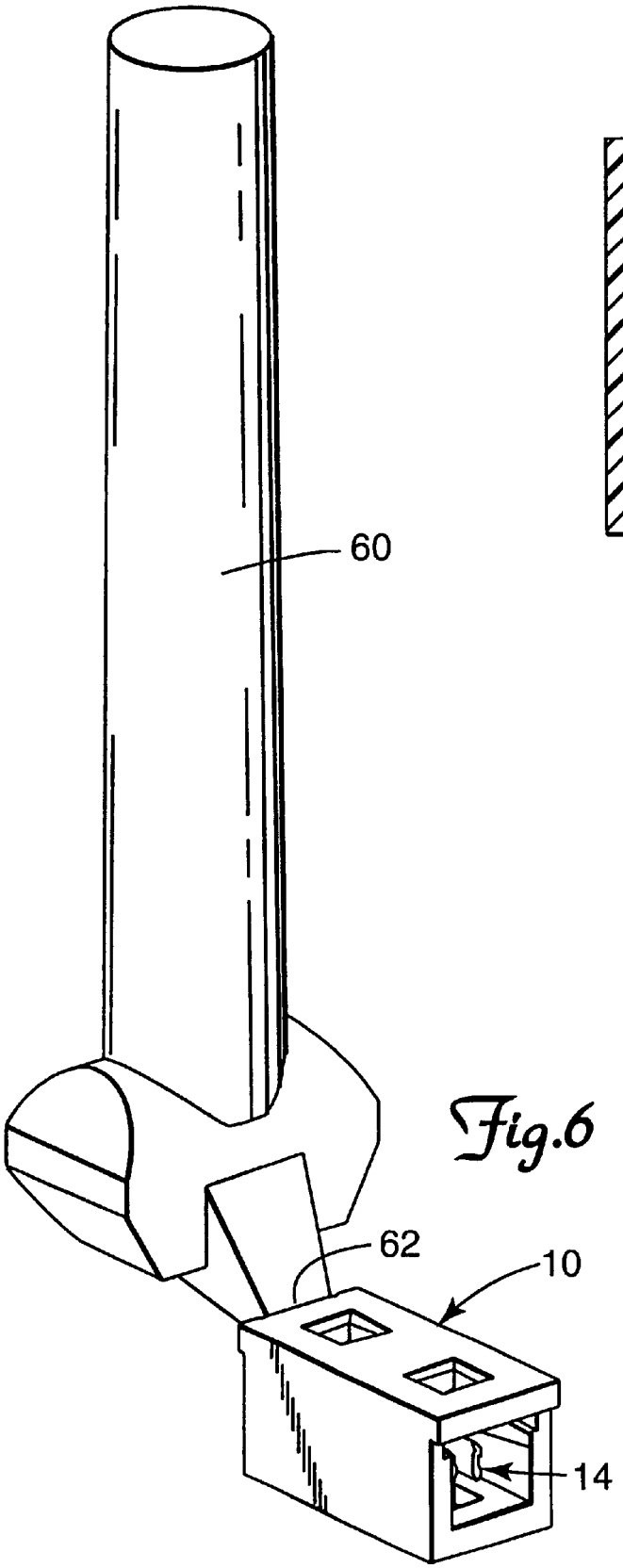
FIG. 6 is a perspective view of the shunt of FIG. 1 with an attached application handle.
Figure 7:
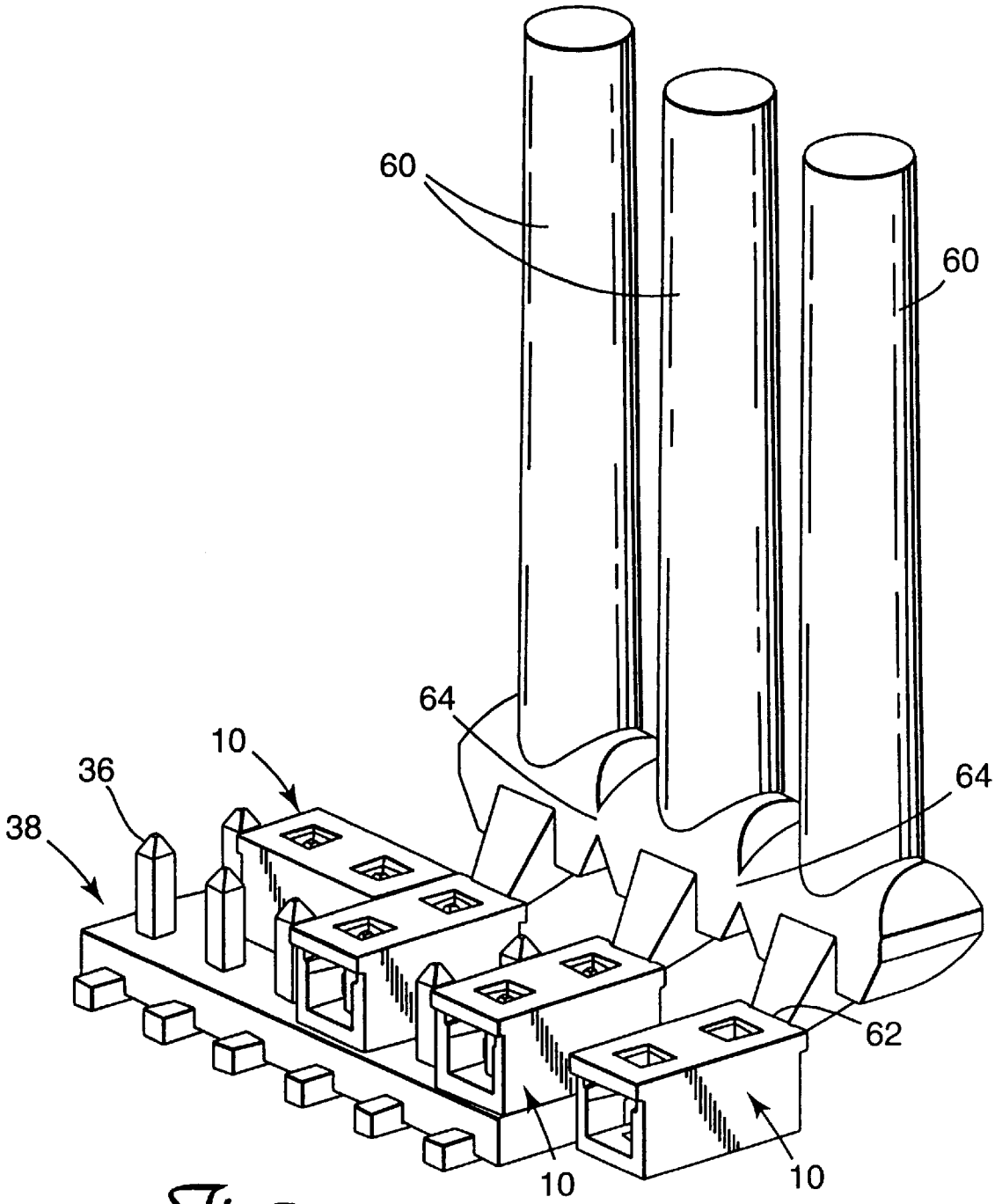
FIG. 7 is a perspective view of a plurality of shunts and application handles connected in a series being applied to a pin field.

The individual inventive shunt 10 described above may be installed on pin field 38 with, for example, tweezers or the user's fingers. However, as shown in FIG. 6, it is preferred that shunt 10 have an application handle 60 attached to housing 12. In the preferred embodiment, housing 12 and application handle 60 are integrally molded as a single unit, with application handle 60 frangibly attached to housing 12 at location 62. The presence of application handle 60 eliminates the need for a separate application tool, such as a pair of tweezers, and ensures that the proper application tool is used with shunt 10. The possibility of the user using an incorrect application tool which may damage shunt 10 or pin field 38 is eliminated. Application handle 60 is preferably ergonomically positioned to allow the user's finger or thumb to act as a natural support for shunt 10, thereby making installation of shunt 10 a very easy operation. For example, it may be desirable to orient handle 60 parallel to the pin insertion axis P, as shown in FIG. 7, such that handle 60 is removed from the plane of the shunt. After shunt 10 has been installed on pin field 38, application handle 60 may be broken free from shunt 10 and the material recycled. The result is a shunt having a lower height than previous shunts in which the handle or gripping feature remains attached, thus adding bulk to the shunt.

Because it is common to install a plurality of shunts in series on a pin field, multiple shunts 10 (with attached application handles 60) may be attached in series as shown in FIG. 7. The pitch of shunts 10 matches the pitch (or multiples of the pitch) of pins 36 in pin field 38, such that a plurality of shunts 10 may be applied as a single unit. Application handles 60 are frangibly connected at location 64 (preferably by being integrally molded), such that any number of shunts 10 and application handles 60 may be separated as desired and applied to pin field 38.

Figure 8:
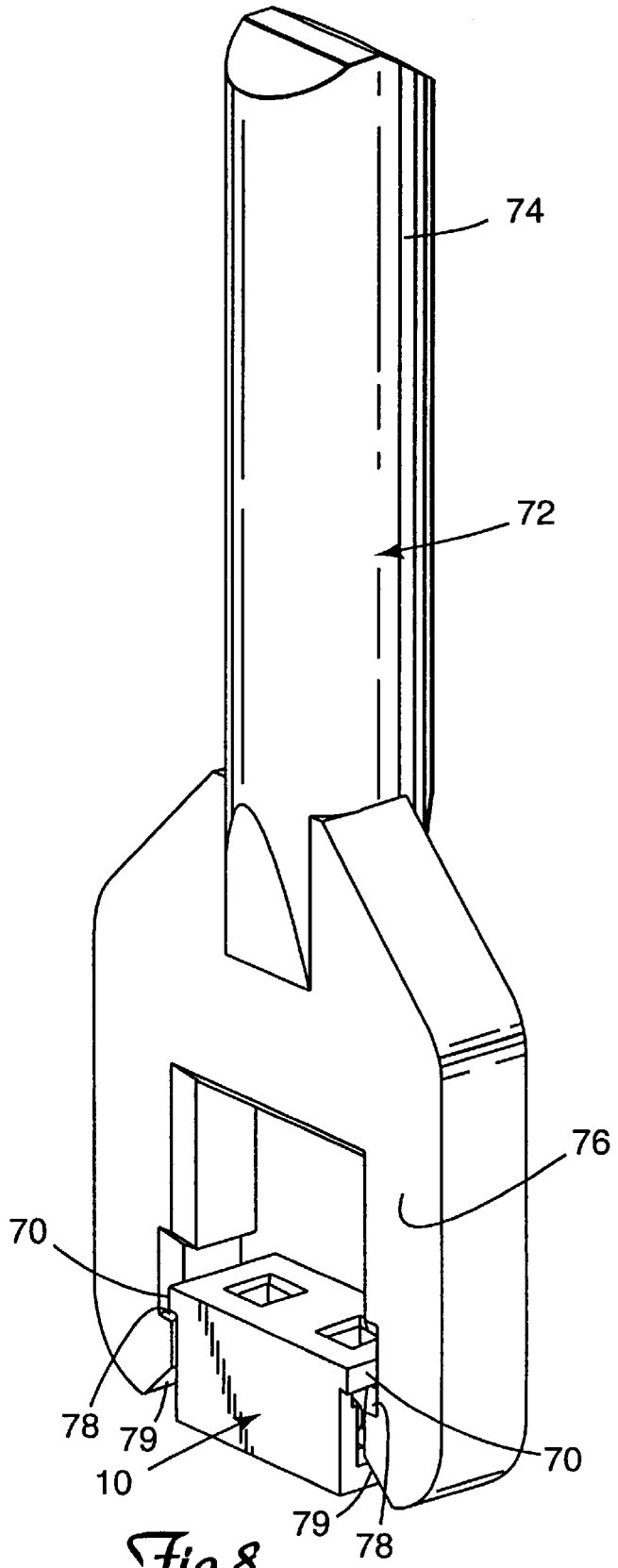
FIG. 8 is a perspective view of an extraction tool gasping an inventive shunt.

Shunts 10 may be installed on pin field 38 only temporarily, and the removal of shunt 10 becomes necessary. Removal of a shunt often requires external tools such as a pair of metal or plastic tweezers, a small screwdriver, or even a pocket knife. Any metal instruments can damage the mating pin field 38 by either bending the pin 36 during the removal process of by causing damage to the plated finish on pins 36. An extraction tool that requires pressure to remove a shunt, such as a pair of tweezers can unknowingly damage the shunt by exerting excessive force. To facilitate the removal of the inventive shunt 10, projections 70 are provided on housing 12. Projections 70 are shaped to be grasped by either a user's fingers, or preferably, an extraction tool 72 as shown in FIG. 8. Extraction tool 72 includes a handle portion 74 and a grasping portion 76. Grasping portion 76 is provided with ledges 78 which are adapted to be positioned under projections 70, such that upward force removes shunt 10 from pin field 38. Extraction tool 72 does not apply any lateral force to shunt 10, and thus reduces the chance of damaging shunt 10 or surrounding pin field 38. Grasping portion 76 is preferably compliant and provides tapered portions 79 such that grasping portion 76 can either be pushed over the top of shunt 10, or slid onto shunt 10 from the side. Those skilled in the art will recognize that other extraction tool configurations could also be used, and variations of extraction tool 72 which do not apply lateral forces to shunt 10 are contemplated.

Figure 9:
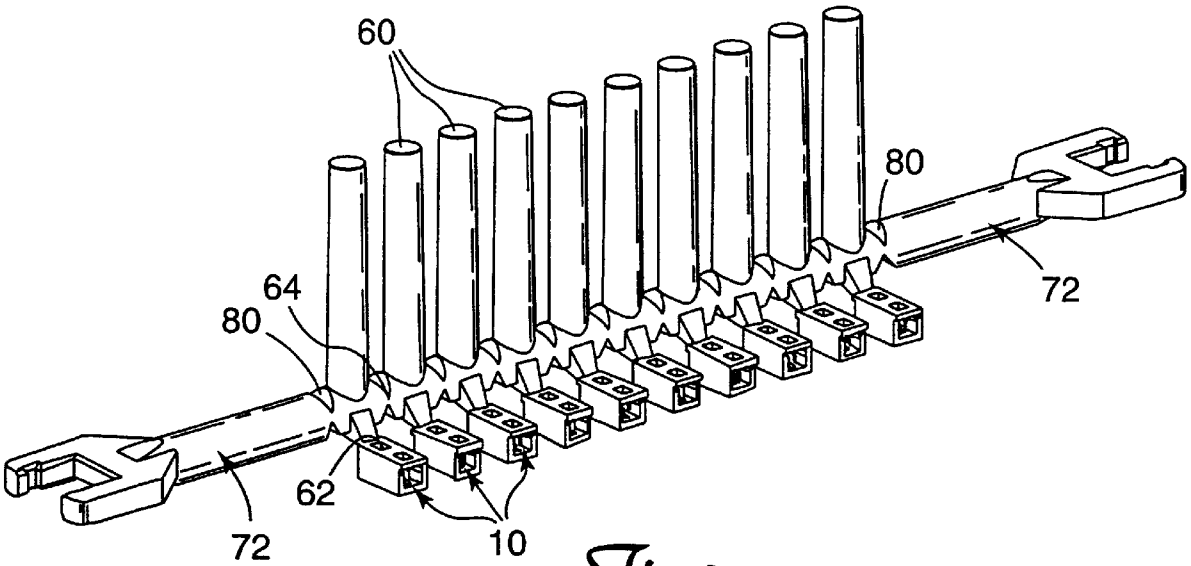
FIG. 9 is a perspective view of the series of application handles and shunts of FIG. 7 with the extraction tool of FIG. 8 integrally attached to the series of application handles.

Extraction tool 72 is preferably formed of an insulative plastic, because plastic will not damage any of the plated surface of pins 36. Further, if shunt 10 is extracted when the fin field is "hot" the insulative plastic will not cause circuit damage. Likewise, circuit damage due to static discharge is avoided by forming extraction tool 72 from plastic. As shown in FIG. 9, extraction tool 72 is preferably formed as an integrally molded part of a series of shunts 10 and application handles 60. As with application handles 60, extraction tool 72 is frangibly attached to the assembly of shunts 10 and application handles at location 80.

By integrally molding the housing 12, application handle 60 and extraction tool 72, it can be assured that the proper application and extraction tools are used, and that the tools will not damage either the shunt 10 or the pin field 38.

Figure 10:
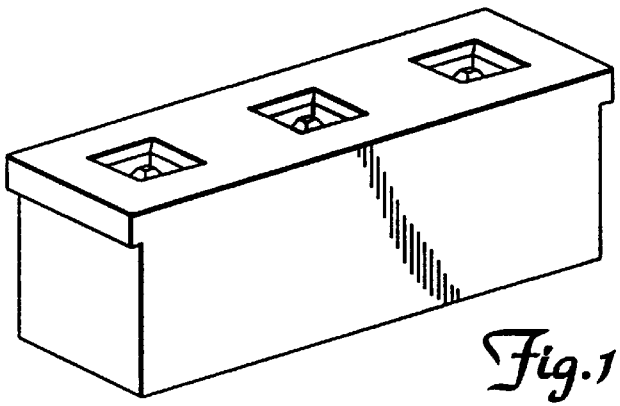
FIG. 10 is an alternate embodiment of the inventive shunt for electrically connecting more than two pins.

Although preferred embodiments of the present invention have been described herein, it is recognized that individuals skilled in the art may readily devise variations and modifications of the invention without departing from the scope of the present invention. For example, as seen in FIG. 10, the inventive shunt could be adapted to receive more than two pins 36 as described above.

What is claimed is:

1. A shunt for shorting adjacent electrically conductive pins in an array of electrically conductive pins, the shunt comprising:

an insulative housing, the housing having a top wall, a bottom wall, a first side wall and a second side wall, the first and second side walls each extending from the top wall to the bottom wall and defining an internal cavity, the bottom wall having a first opening and a second opening extending into the internal cavity, the first and second openings adapted for receiving a pair of conductive pins along a pin insertion axis; and an electrically conductive contact positioned within the internal cavity of the housing, the conductive contact comprising a spring biased clip joining a central portion of a first longitudinal wiper and a central portion a second longitudinal wiper, the spring biased clip being positioned between the first and second openings in the bottom wall;

whereby the pair of conductive pins are inserted through the first and second openings in the bottom wall such that the spring biased clip is positioned between the pins and the pins are captured between the first and second wipers of the conductive contact.

2. The shunt of claim 1, wherein the longitudinal axis of the first wiper and the longitudinal axis of the second wiper are transverse to the pin insertion axis.

3. The shunt of claim 1, wherein the spring biased clip of the conductive contact comprises a resilient conductive material bent to form a first leg and a second leg, the first and second legs of the spring biased generally aligned with the pin insertion axis, the first and second longitudinal wipers extending transversely from the first and second legs.

4. The shunt of claim 1, wherein the first and second openings in the bottom wall include beveled edges for guiding conductive pins into the housing.

5. The shunt of claim 1, wherein the housing further includes at least one protrusion adapted to be grasped by the user.

6. The shunt of claim 5, wherein the protrusion is integral with a wall of the housing.

7. The shunt of claim 1, further comprising first and second openings in the top wall of the housing, the first and second openings of the top wall aligned with the first and second openings of the bottom wall for receiving conductive pins.

8. The shunt of claim 1, further comprising an application handle frangibly attached to the housing.

9. The shunt of claim 8, further comprising a plurality of application handles and frangibly attached housings connected to form a series of application handles and housings.

10. The shunt of claim 9, wherein each of the plurality of application handles and housings are frangibly separable from each other.

11. The shunt of claim 9, wherein the series of application handles and housings has a pitch equal to the pitch, or a multiple thereof, of the array of pins on which the series of housings is to be installed.

12. The shunt of claim 9, further comprising an extraction tool frangibly connected to the series of application handles and housings.

13. The shunt of claim 8, wherein the application handle and the housing are integrally molded.

14. The shunt of claim 9, wherein the series of application handles and housings are integrally molded.

15. The shunt of claim 14, wherein an extraction tool is integrally molded to the series of application handles and housings.

* * * * *

UNITED STATES PATENT AND TRADEMARK OFFICE

CERTIFICATE OF CORRECTION

PATENT NO. : 6,099,347
DATED : August 8, 2000
INVENTOR(S) : Tim Keith Hoyt and Steven Feldman It is certified that error appears in the above-identified patent and that said Letters Patent is hereby corrected as shown below:

Cover page,
Item [75] should read:
[75] inventors: Tim Keith Hoyt, Mentor; Steven Feldman, Madison, both of Minn.

Signed and Sealed this

Seventeenth Day of July, 2001

*Attest:*

Nicholas P. Godici

*Attesting Officer*

NICHOLAS P. GODICI
*Acting Director of the United States Patent and Trademark Office*